US010887686B2

(12) United States Patent
Wang

(10) Patent No.: US 10,887,686 B2
(45) Date of Patent: Jan. 5, 2021

(54) DIRECTIONAL MICROPHONE

(71) Applicant: Ampacs Corporation, Taipei (TW)

(72) Inventor: Rui-Lin Wang, Taipei (TW)

(73) Assignee: Ampacs Corporation, Taipei (TW)

( * ) Notice: Subject to any disclaimer, the term of this patent is extended or adjusted under 35 U.S.C. 154(b) by 0 days.

(21) Appl. No.: 16/519,016

(22) Filed: Jul. 23, 2019

(65) Prior Publication Data

US 2020/0077179 A1 Mar. 5, 2020

Related U.S. Application Data

(60) Provisional application No. 62/723,498, filed on Aug. 28, 2018.

(30) Foreign Application Priority Data

Mar. 27, 2019 (CN) ..... 2019 1 0239549

(51) Int. Cl.

| | |
|---|---|
| ***H04R 1/34*** | (2006.01) |
| ***H04R 1/02*** | (2006.01) |
| ***H04R 1/08*** | (2006.01) |
| ***H04R 1/04*** | (2006.01) |
| ***H04R 1/28*** | (2006.01) |

(52) U.S. Cl.

CPC ..... *H04R 1/342* (2013.01); *H04R 1/021* (2013.01); *H04R 1/04* (2013.01); *H04R 1/08* (2013.01); *H04R 1/2807* (2013.01)

(58) Field of Classification Search

USPC .... 381/91, 92, 313, 355, 356, 357, 381, 361

See application file for complete search history.

(56) References Cited

U.S. PATENT DOCUMENTS

| | | | | |
|---|---|---|---|---|
| 5,836,790 | A | 11/1998 | Barnett | |
| 6,285,771 | B1 * | 9/2001 | Killion | H04R 1/406 381/313 |
| 2008/0075313 | A1 | 3/2008 | Lan et al. | |
| 2012/0140968 | A1 | 6/2012 | Tada et al. | |

(Continued)

FOREIGN PATENT DOCUMENTS

| | | |
|---|---|---|
| CN | 101198235 | 6/2008 |
| CN | 202059565 | 11/2011 |

(Continued)

OTHER PUBLICATIONS

"Office Action of China Counterpart Application", dated Sep. 2, 2020, pp. 1-11.

*Primary Examiner* — Yosef L Laekermariam
(74) *Attorney, Agent, or Firm* — JCIPRNET

(57) ABSTRACT

A directional microphone including a casing and a microphone element is provided. The casing has a front sound reception hole and at least one rear sound reception hole. The microphone element is disposed in the casing. The microphone element has a front sound reception surface and a rear sound reception surface. The front sound reception hole is located on a same side as the front sound reception surface, and the front sound reception hole is aligned with the front sound reception surface. The rear sound reception hole is located on a same side as the rear sound reception surface, but the rear sound reception hole and the rear sound reception surface are misaligned with each other.

13 Claims, 10 Drawing Sheets

(56) References Cited

U.S. PATENT DOCUMENTS

| | | | | |
|---|---|---|---|---|
| 2014/0093114 | A1* | 4/2014 | Nguyen | H04R 1/02<br>381/361 |
| 2014/0094405 | A1 | 4/2014 | Pessi et al. | |
| 2016/0037254 | A1 | 2/2016 | Akino | |
| 2018/0167709 | A1 | 6/2018 | Yoo | |

FOREIGN PATENT DOCUMENTS

| | | |
|---|---|---|
| CN | 102395066 | 3/2012 |
| CN | 103888880 | 6/2014 |
| CN | 203761584 | 8/2014 |
| CN | 107566930 | 1/2018 |
| CN | 209693030 | 11/2019 |
| EP | 0493361 | 5/1993 |
| FR | 2924523 | 6/2009 |
| JP | 2005295278 | 10/2005 |
| TW | 200808093 | 2/2008 |
| TW | 200830921 | 7/2008 |
| TW | 200835612 | 9/2008 |
| TW | 201026099 | 7/2010 |
| TW | 201028019 | 7/2010 |

* cited by examiner

DIRECTIONAL MICROPHONE

CROSS-REFERENCE TO RELATED APPLICATION

This application claims the priority benefits of U.S. provisional application Ser. No. 62/723,498, filed on Aug. 28, 2018, and China application serial no. 201910239549.9, filed on Mar. 27, 2019. The entirety of each of the above-mentioned patent applications is hereby incorporated by reference herein and made a part of this specification.

BACKGROUND OF THE INVENTION

Field of the Invention

The disclosure relates to a directional microphone.

Description of Related Art

As technology constantly advances, personal electronic products are developing to become light in weight and small in size. Smartphones, tablet computers, laptop computers, etc. have become indispensable in people's daily lives. In the above electronic products, an earphone with a microphone is a common accessory for facilitating long-distance communication of users, and most importantly, long-distance voice transmission between the two communicating parties. At this time, how sound reception, and particularly, low-noise and high-quality sound reception can be effectively performed respectively at the two distant communicating ends through a microphone depends on an excellent sound reception system.

SUMMARY OF THE INVENTION

The disclosure relates to a directional microphone that can maintain directivity at a required audio frequency.

According to an embodiment of the invention, a directional microphone includes a casing and a microphone element. The casing has a front sound reception hole and at least one rear sound reception hole. The microphone element is disposed in the casing. The microphone element has a front sound reception surface and a rear sound reception surface. The front sound reception hole is located on a same side as the front sound reception surface, and the front sound reception hole is aligned with the front sound reception surface. The rear sound reception hole is located on a same side as the rear sound reception surface, but the rear sound reception hole and the rear sound reception surface are misaligned with each other.

In the directional microphone according to an embodiment of the invention, the microphone element has a first axis orthogonal to the front sound reception surface, and the front sound reception hole is located on the first axis.

In the directional microphone according to an embodiment of the invention, the microphone element has a second axis orthogonal to the rear sound reception surface, and the rear sound reception hole is not located on the second axis.

In the directional microphone according to an embodiment of the invention, the casing has a first plane and a second plane opposite to each other, the front sound reception hole is located in the first plane, and the rear sound reception hole is located in the second plane.

In the directional microphone according to an embodiment of the invention, the first plane is parallel to the front sound reception surface of the microphone element, and the second plane is parallel to the rear sound reception surface of the microphone element.

In the directional microphone according to an embodiment of the invention, the microphone element has a first axis and a second axis, the first axis is orthogonal to the front sound reception surface, and the second axis is orthogonal to the rear sound reception surface. The front sound reception hole has a third axis, the rear sound reception hole has a fourth axis, the first axis and the third axis are coaxially disposed, and a lateral distance is present between the second axis and the fourth axis.

The directional microphone according to an embodiment of the invention further includes a filler disposed between the casing and the microphone element. The filler exposes the microphone element only on the front sound reception surface and the rear sound reception surface, and the filler isolates the front sound reception surface and the rear sound reception surface.

In the directional microphone according to an embodiment of the invention, when a sound having a frequency higher than or equal to 3 kHz is received, a sensitivity difference between sounds received by the front sound reception surface and the rear sound reception surface is consistent.

In the directional microphone according to an embodiment of the invention, when a sound having a frequency higher than or equal to 5 kHz is received, a sensitivity difference between sounds received by the front sound reception surface and the rear sound reception surface is consistent.

In the directional microphone according to an embodiment of the invention, the sensitivity difference is equal to 5 dB.

In the directional microphone according to an embodiment of the invention, the directional microphone is a unidirectional microphone.

In the directional microphone according to an embodiment of the invention, the directional microphone is a hypercardioid microphone.

In the directional microphone according to an embodiment of the invention, the front sound reception hole is located on a same side as a sound source.

In the directional microphone according to an embodiment of the invention, a rear side sound reception path is present between the rear sound reception hole and the rear sound reception surface, a front side sound reception path is present between the front sound reception hole and the front sound reception surface, and the rear side sound reception path is longer than the front side sound reception path.

In the directional microphone according to an embodiment of the invention, the casing has a pair of rear sound reception holes and a pair of rear side sound reception paths, an orientation of each of the rear sound reception holes is in line with an orientation of the rear sound reception surface, but each of the rear sound reception holes is far away from the rear sound reception surface. One of the rear side sound reception paths connects one of the rear sound reception holes and the rear sound reception surface, and another of the rear side sound reception paths connects another of the rear sound reception holes and the rear sound reception surface.

BRIEF DESCRIPTION OF THE DRAWINGS

The accompanying drawings are included to allow further understanding of the invention, and the drawings are incorporated into the specification and form a part of the specification. The drawings illustrate the embodiments of the invention, and the drawings and the description together are used to interpret the principles of the invention.

DESCRIPTION OF THE EMBODIMENTS

Figure 1:
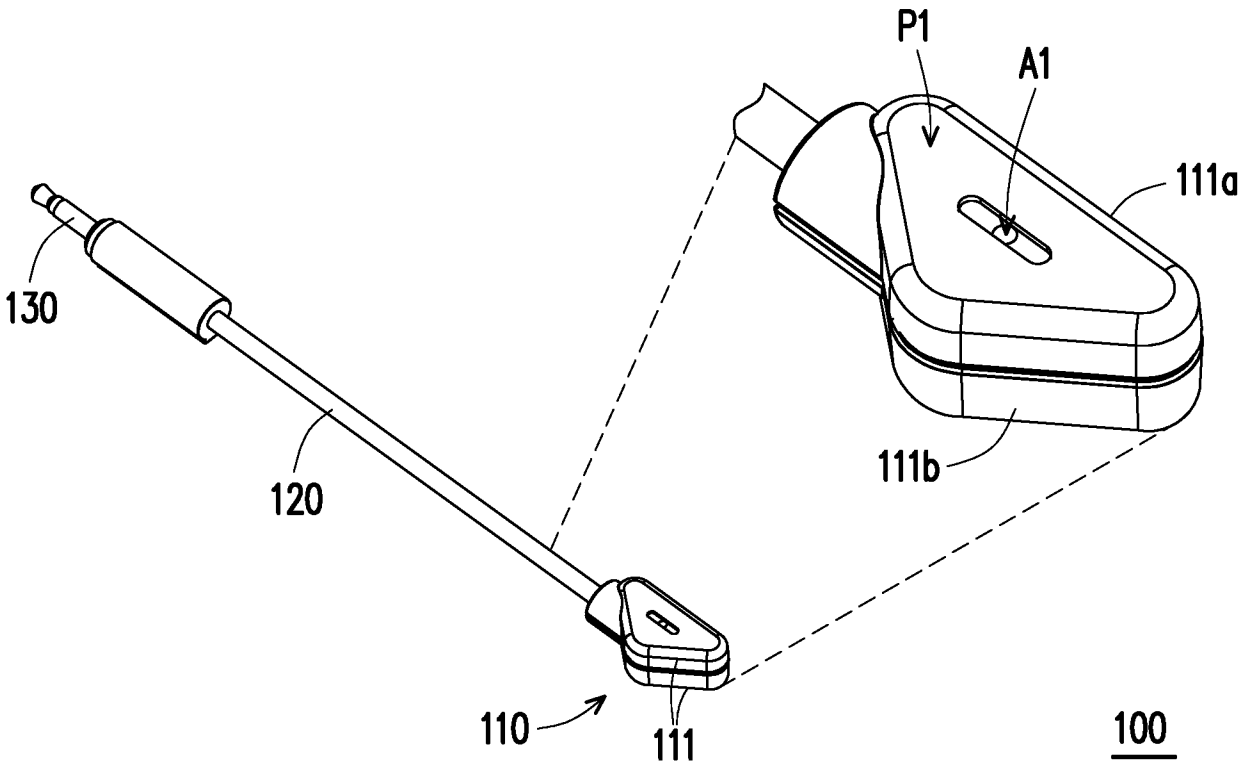
FIG. 1 is a schematic view of a directional microphone according to an embodiment of the invention.

Reference will now be made in detail to the exemplary embodiments of the invention, examples of which are illustrated in the accompanying drawings. Wherever possible, the same reference numbers are used in the drawings and the description to refer to the same or like parts.

Figure 2:
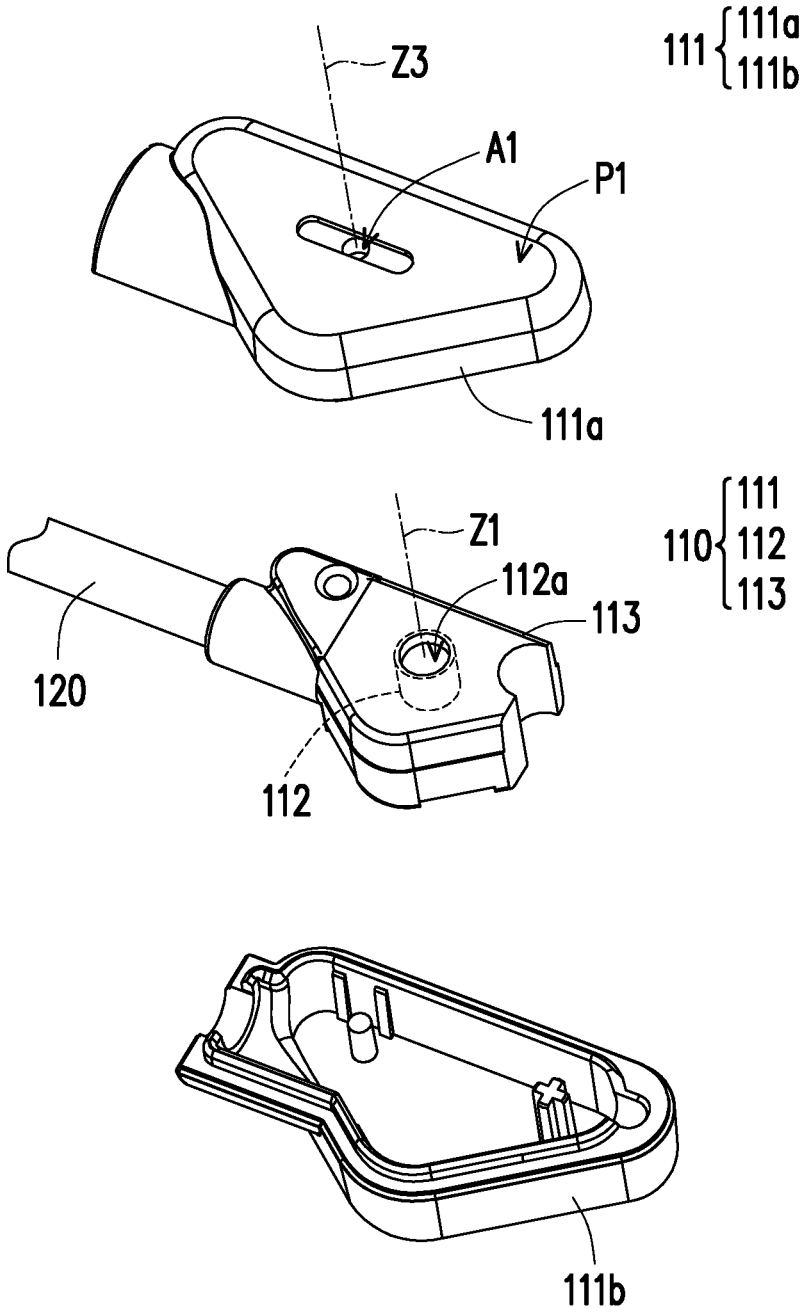
FIG. 2 is a partial exploded view of the directional microphone of FIG. 1.

FIG. 1 is a schematic view of a directional microphone according to an embodiment of the invention. FIG. 2 is a partial exploded view of the directional microphone of FIG. 1. Referring to FIG. 1 and FIG. 2, in the present embodiment, a directional microphone 100 includes a microphone structure 110, a cable 120, and a connection terminal 130. The microphone structure 110 includes a casing 111, and a microphone element 112 and a filler 113 disposed in the casing 111. Moreover, the microphone element 112 is electrically connected to the connection terminal 130 via the cable 120. Therefore, the user can insert the connection terminal 130 into a sound reception hole (not shown) of an electronic device to cause the directional microphone 100 to operate normally to receive sound. The form of the electronic device is not limited herein, and the electronic device may be an earphone with a sound reception hole, or a portable electronic device or a communication device such as a mobile phone or a tablet computer.

Figure 3:
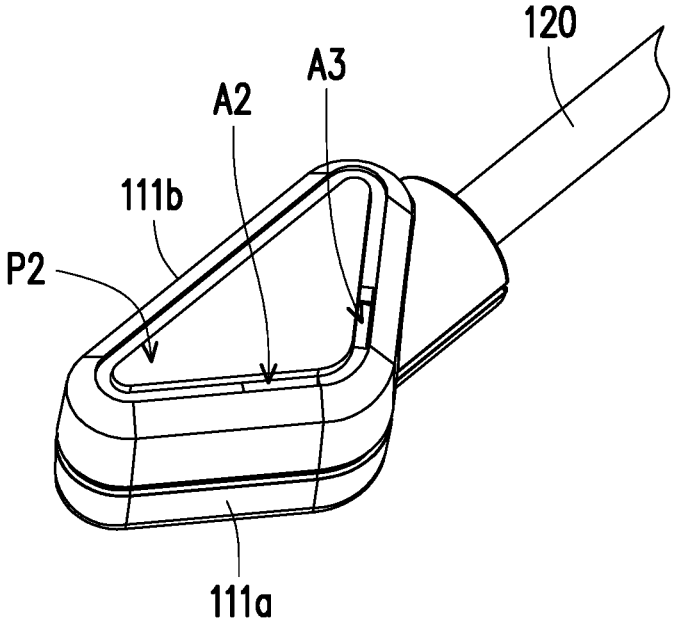
FIG. 3 shows the directional microphone of FIG. 1 from another perspective.
Figure 4:
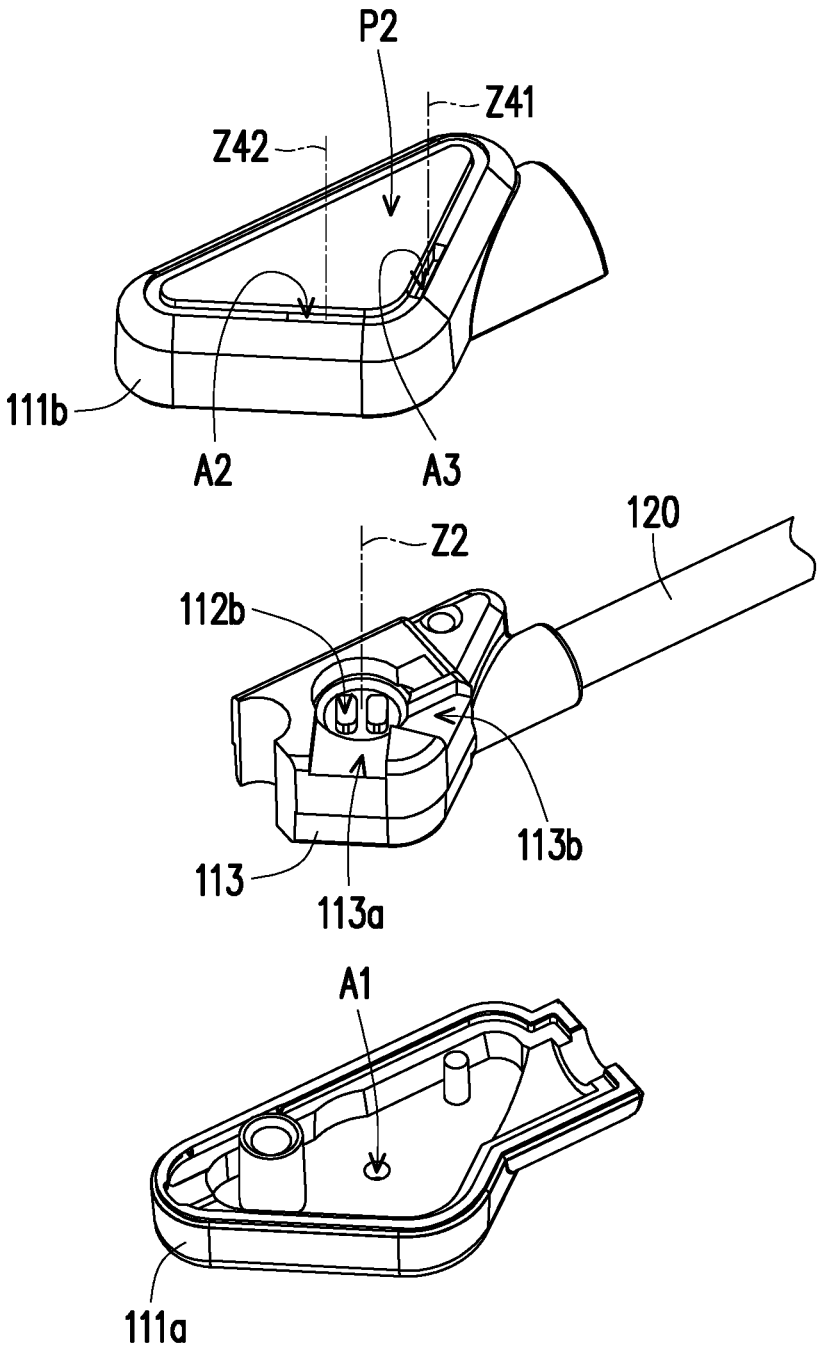
FIG. 4 is a partial exploded view of the directional microphone of FIG. 3.

FIG. 3 shows the directional microphone of FIG. 1 from another perspective. FIG. 4 is a partial exploded view of the directional microphone of FIG. 3. Referring to FIG. 2 to FIG. 4 at the same time, in the present embodiment, the casing 111 is formed by combining a front case 111*a* and a rear case 111*b* to each other (and at the same time, also combining to one end of the cable 120). The filler 113 and the microphone element 112 are housed between the front case 111*a* and the rear case 111*b*. The filler 113 is disposed between the casing 111 and the microphone element 112 such that the microphone element 112 is exposed only on a front sound reception surface 112*a* and a rear sound reception surface 112*b*, and the front sound reception surface 112*a* and the rear sound reception surface 112*b* are isolated from each other by the filler 113. Correspondingly, the casing 111 has a front sound reception hole A1 and a pair of rear sound reception holes A2 and A3. The front sound reception hole A1 is disposed in a first plane P1 of the front case 111*a*. The front sound reception hole A1 has a third axis Z3 (which represents the orientation of the front sound reception hole A1), and the third axis Z3 is orthogonal to the first plane P1. The rear sound reception holes A2 and A3 are disposed in a second plane P2 of the rear case 111*b*. The first plane P1 is parallel to the second plane P2, the first plane P1 is parallel to the front sound reception surface 112*a*, and the second plane P2 is parallel to the rear sound reception surface 112*b*. The rear sound reception holes A2 and A3 respectively have corresponding fourth axes Z42 and Z41, and the fourth axes Z42 and Z41 are orthogonal to the second plane P2 respectively. Further, the microphone element 112 has a first axis Z1 and a second axis Z2. The first axis Z1 is orthogonal to the front sound reception surface 112*a*, and the second axis Z2 is orthogonal to the rear sound reception surface 112*b*.

It is noted that, as shown in FIG. 2 and FIG. 4, after the microphone element 112 is mounted into the filler 113, only the front sound reception surface 112*a* and the rear sound reception surface 112*b* are exposed. Next, after the front case 111*a* and the rear case 111*b* are mounted, the front sound reception hole A1 is located on the same side as the front sound reception surface 112*a*, and the front sound reception hole A1 is aligned with the front sound reception surface 112*a*. In contrast, the rear sound reception holes A2 and A3 are located on the same side as the rear sound reception surface 112*b*, but the rear sound reception holes A2 and A3 and the rear sound reception surface 112*b* are in a mutually misaligned state.

Figure 5A:
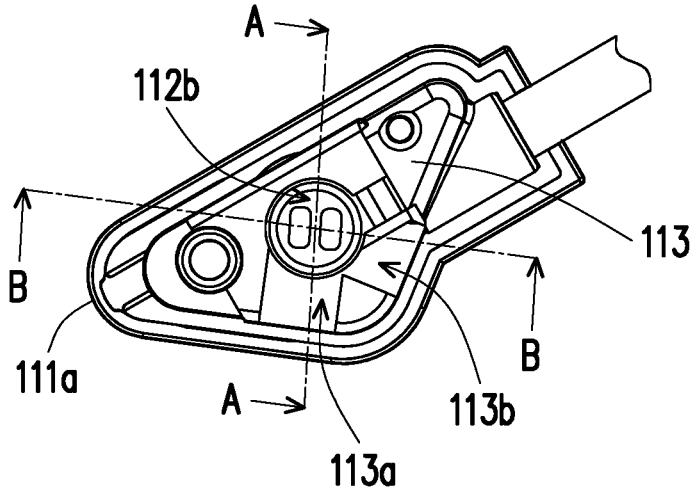
FIG. 5A is a top view of the directional microphone of FIG. 3.
Figure 5B:
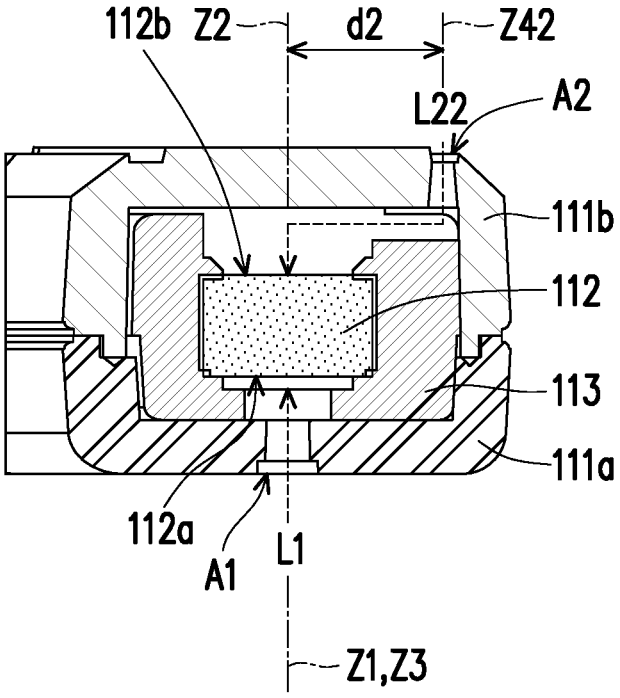
FIG. 5B is a cross-sectional view of the directional microphone of FIG. 5A taken along line A-A.
Figure 5C:
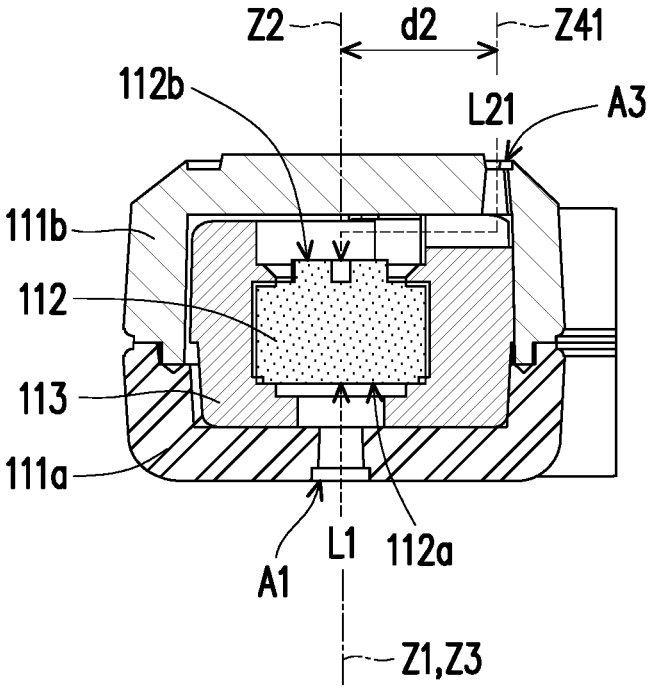
FIG. 5C is a cross-sectional view of the directional microphone of FIG. 5A taken along line B-B.

FIG. 5A is a top view of the directional microphone of FIG. 3. FIG. 5B is a cross-sectional view of the directional microphone of FIG. 5A taken along line A-A. FIG. 5C is a cross-sectional view of the directional microphone of FIG. 5A taken along line B-B. Referring to FIG. 5A to FIG. 5C at the same time, more specifically, since the front sound reception hole A1 and the front sound reception surface 112*a* are aligned with each other, the first axis Z1 and the third axis Z3 are coaxially disposed. In other words, the front sound reception hole A1 is located on the first axis Z1 of the microphone element 112. In addition, the rear sound reception holes A2 and A3 are substantially located at the side edges of the rear case 111*b* and respectively correspond to two mutually separated channels 113*a* and 113*b* of the filler 113. Therefore, the fourth axes Z41 and Z42 and the second axis Z2 of the microphone element 112 are three axes that are substantially parallel but are not coincident with each other. In other words, the rear sound reception holes A2 and A3 are not located on the second axis Z2.

Accordingly, it can be learned from the above structural features of the microphone structure 110 that different designs are provided for the sound reception paths. As shown in FIG. 5B and FIG. 5C, with respect to the front sound reception hole A1, the received sound is transmitted along a front side sound reception path L1 (linear path) and causes direct effect on the front sound reception surface 112*a* of the microphone element 112. However, non-linear rear side sound reception paths L21 and L22 are present respectively between the rear sound reception holes A2 and A3 and the rear sound reception surface 112*b* of the microphone element 112, and the rear side sound reception paths L21 and L22 are respectively longer than the front side sound reception path L1. Therefore, the sounds entering via the rear sound reception holes A2 and A3 are respectively transmitted along the rear side sound reception paths L21 and L22 and cause effect on the rear sound reception surface 112*b* of the microphone element 112. In other words, although the orientations of the rear sound reception holes A2 and A3 are substantially in line with the orientation of the rear sound reception surface 112*b*, they are far away from each other. Namely, lateral distances d1 and d2 are present respectively between the fourth axes Z41 and Z42 of the rear sound reception holes A2 and A3 and the second axis Z2 of the rear sound reception surface 112*b*.

Figure 6A:
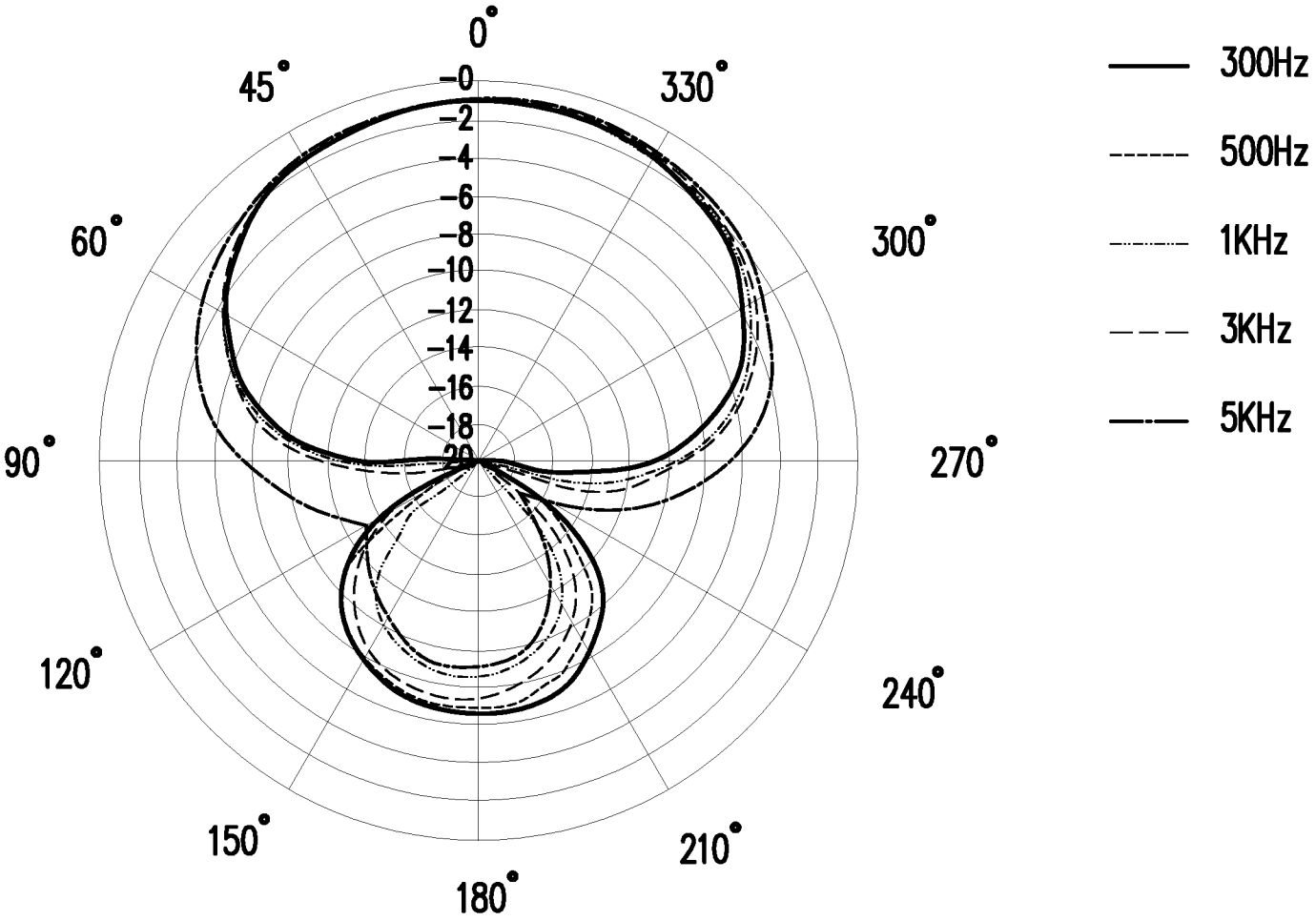
FIG. 6A is a sound field diagram of the directional microphone of the present embodiment.
Figure 6B:
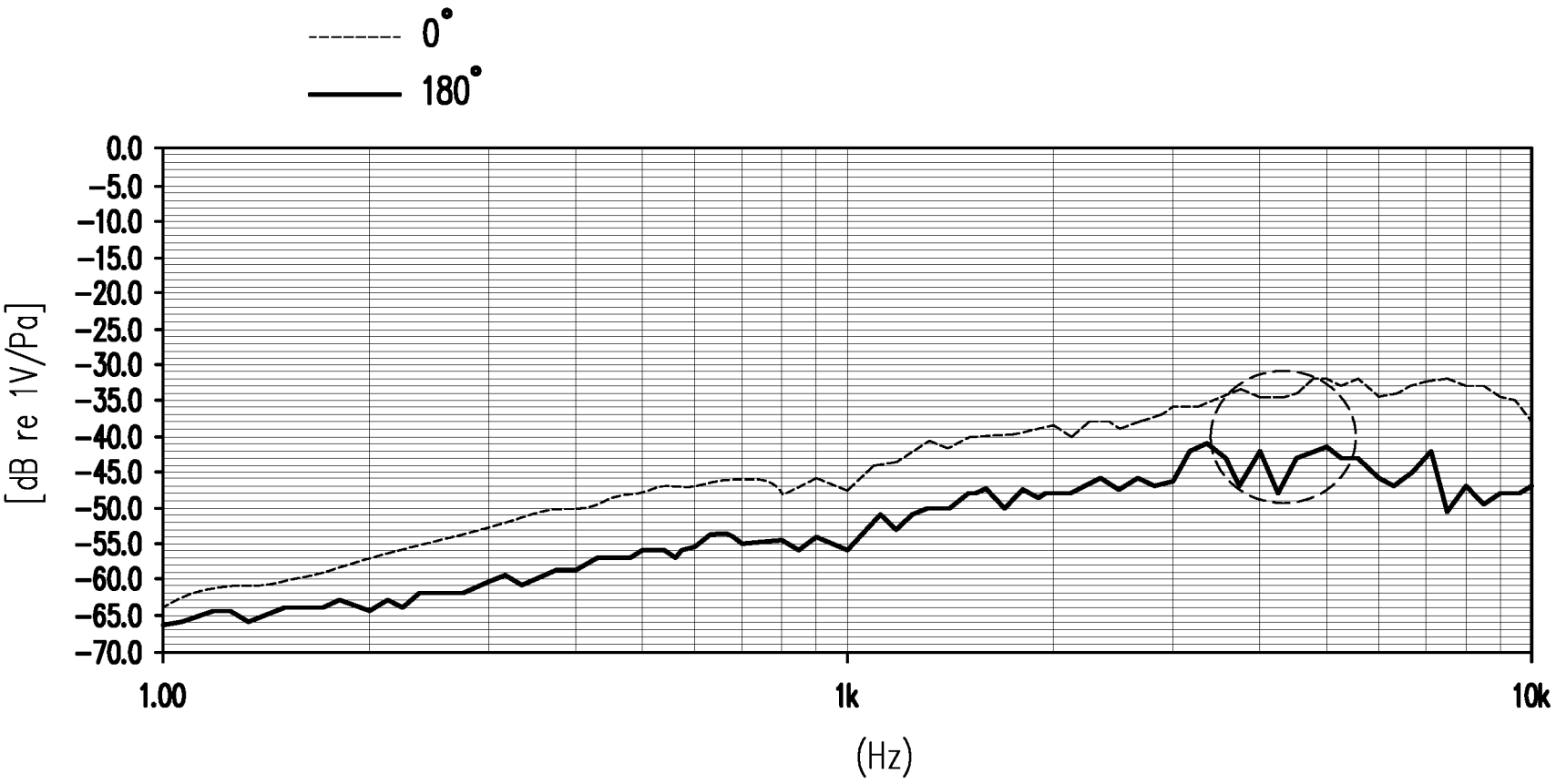
FIG. 6B is a spectrogram corresponding to FIG. 6A.
Figure 7A:
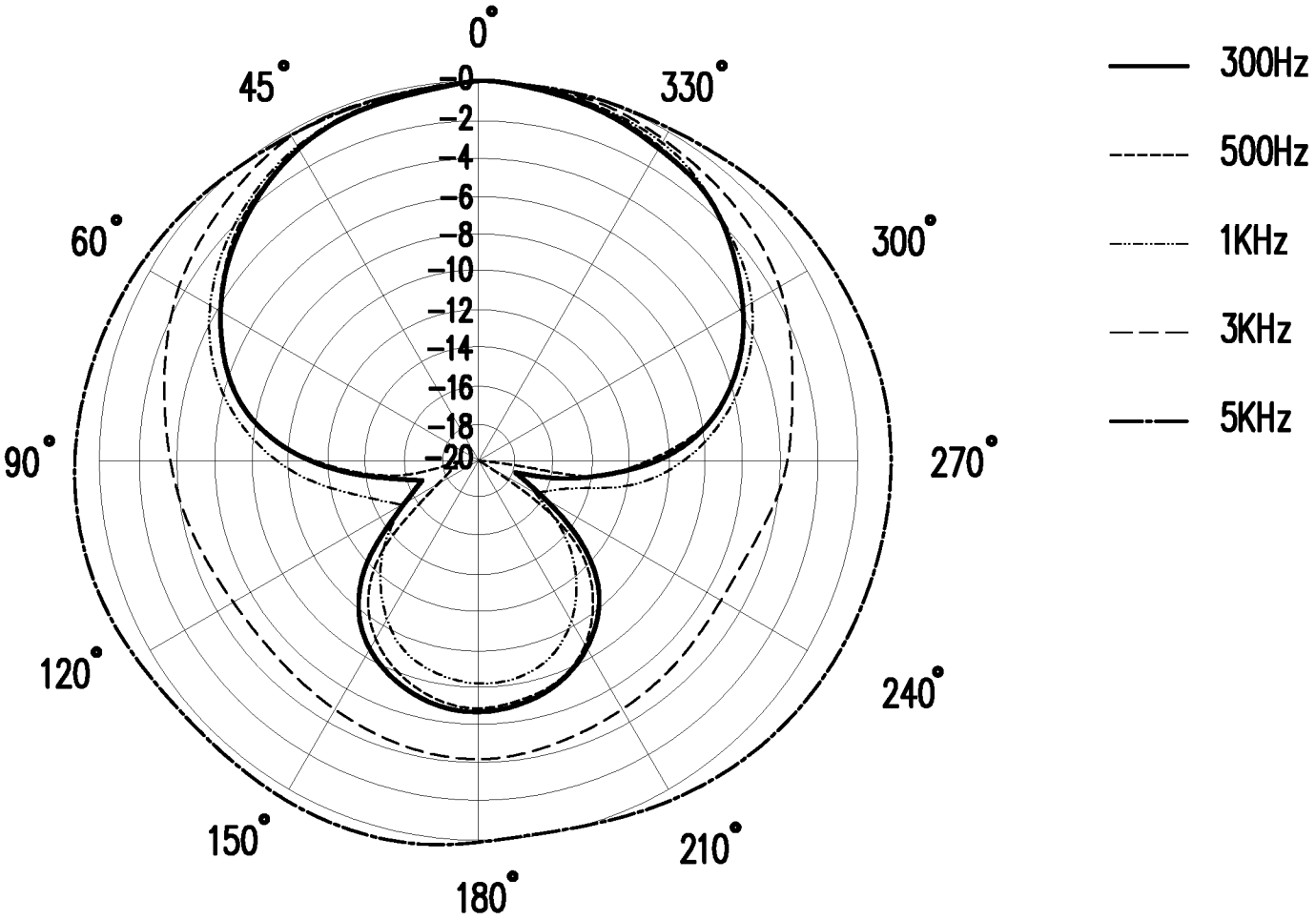
FIG. 7A is a sound field diagram of a microphone of related art.
Figure 7B:
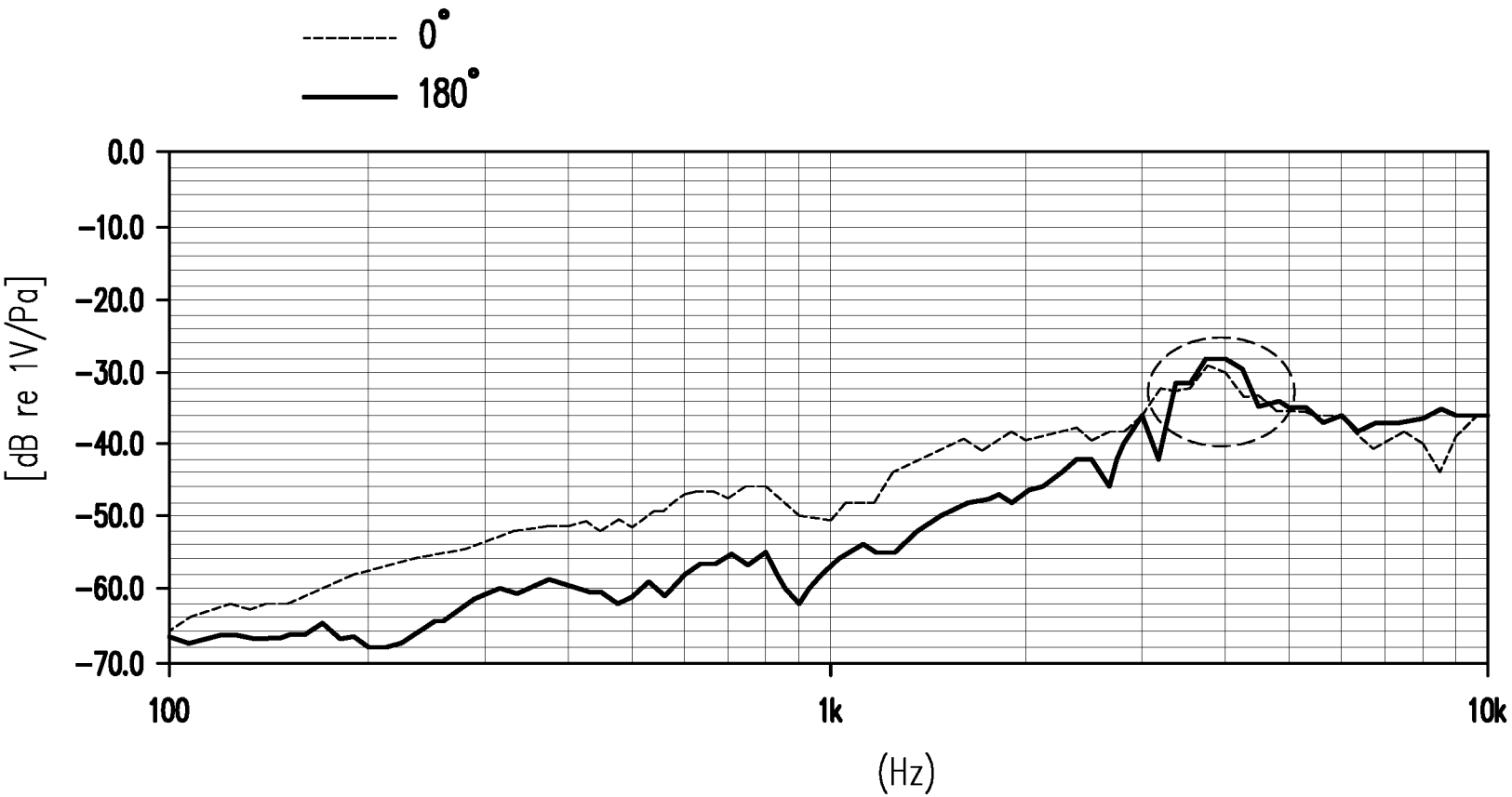
FIG. 7B is a spectrogram corresponding to FIG. 7A.

FIG. 6A is a sound field diagram of the directional microphone of the present embodiment. FIG. 6B is a spectrogram corresponding to FIG. 6A. FIG. 7A is a sound field diagram of a microphone of related art. FIG. 7B is a spectrogram corresponding to FIG. 7A. Referring to FIG. 6A and FIG. 6B first, in the present embodiment, the directional microphone 100 is a unidirectional microphone, and in particular, a hypercardioid microphone. When the sound source is located on the same side as the front sound reception hole A1 on the casing 111, the sound field diagram of FIG. 6A and the spectrogram of FIG. 6B may be generated. Here, taking sounds of different frequencies (including 300 Hz, 500 Hz, 1 kHz, 3 kHz, and 5 kHz) as an example, the directional microphone of the present embodiment can achieve excellent directivity regardless of the frequency. For example, when a sound having a frequency higher than or equal to 3 kHz or 5 kHz is received, the sensitivity difference between the sounds received by the front sound reception surface 112*a* and the rear sound reception surface 112*b* of the microphone element 112 is consistent. This is manifested in FIG. 6B as the spectrum (the curve indicating the direction as 0 degrees) of the sound received by the front sound reception surface 112*a* and the spectrum (the curve indicating the direction as 180 degrees) of the sound received by the rear sound reception surface 112*b*, which are in a substantially mutually parallel state (as indicated at the portion circled by the dashed line in FIG. 6B). In other words, the sensitivity difference is substantially equal to 5 dB.

In contrast, FIG. 7A and FIG. 7B show a microphone of the related art, in which the microphone has only one front sound reception hole and one rear sound reception hole respectively on the front side and the rear side of the casing, and the front sound reception hole and the rear sound reception hole are located on the same axis as the front sound reception surface and the rear sound reception surface of the microphone element. Accordingly, the microphone still has directivity at lower frequencies (300 Hz, 500 Hz, and 1 kHz). However, once the sound frequency increases, for example, to the frequency of 3 kHz and 5 kHz, the sound field becomes omnidirectional. In other words, in the spectrogram shown in FIG. 7B, in the range from 3 kHz to 5 kHz, the spectral curves of the sounds respectively received by the front sound reception surface and the rear sound reception surface coincide with each other (as indicated at the portion circled by the dashed line in FIG. 7B). This means that the sound in this frequency range is no longer distinguishable by the microphone element.

In summary of the above, in the microphone structure of the directional microphone according to the above embodiment of the invention, the rear sound reception holes of the casing and the rear sound reception surface of the microphone element are misaligned with each other, such that when the external sound enters the casing via the rear sound reception holes, the sound can be transmitted along the rear side sound reception paths between the rear sound reception holes and the rear sound reception surface. Moreover, since the presence of the filler can effectively isolate the front sound reception surface and the rear sound reception surface of the microphone element, it is possible to effectively prevent mutual interference between the front side sound reception and the rear side sound reception. Furthermore, since the rear sound reception holes and the rear sound reception surface are not aligned with each other, the entering sound is transmitted through the channel before it can cause effect on the rear sound reception surface. As a result, in a higher frequency range, for example, from 3 kHz to 5 kHz or more, the sensitivity difference with respect to the sound received by the front sound reception surface can be maintained. In other words, unidirectivity of the microphone element can be maintained to avoid indistinguishability between the sounds received by the front sound reception surface and the rear sound reception surface.

Lastly, it shall be noted that the foregoing embodiments are meant to illustrate, rather than limit, the technical solutions of the invention. Although the invention has been detailed with reference to the foregoing embodiments, persons ordinarily skilled in the art shall be aware that they may still make modifications to the technical solutions recited in the foregoing embodiments or make equivalent replacements of part or all of the technical features therein, and these modifications or replacements do not cause the nature of the corresponding technical solutions to depart from the scope of the technical solutions of the embodiments of the invention.

What is claimed is:

1. A directional microphone comprising:

a casing having a front sound reception hole and at least one rear sound reception hole; and a microphone element disposed in the casing, the microphone element having a front sound reception surface and a rear sound reception surface, wherein the front sound reception hole is located on a same side as the front sound reception surface, and the front sound reception hole is aligned with the front sound reception surface, wherein the at least one rear sound reception hole is located on a same side as the rear sound reception surface, but the at least one rear sound reception hole and the rear sound reception surface are misaligned with each other, wherein the casing has a first plane and a second plane opposite to each other, the front sound reception hole is located in the first plane, and the at least one rear sound reception hole is located in the second plane.

2. The directional microphone according to claim 1, wherein the microphone element has a first axis, the first axis is orthogonal to the front sound reception surface, and the front sound reception hole is located on the first axis.

3. The directional microphone according to claim 1, wherein the microphone element has a second axis, the second axis is orthogonal to the rear sound reception surface, and the at least one rear sound reception hole is not located on the second axis.

4. The directional microphone according to claim 1, wherein the first plane is parallel to the front sound reception surface of the microphone element, and the second plane is parallel to the rear sound reception surface of the microphone element.

5. The directional microphone according to claim 1, wherein the microphone element has a first axis and a second axis, the first axis is orthogonal to the front sound reception surface, and the second axis is orthogonal to the rear sound reception surface, wherein the front sound reception hole has a third axis, the at least one rear sound reception hole has a fourth axis, the first axis and the third axis are coaxially disposed, and a lateral distance is present between the second axis and the fourth axis.

6. The directional microphone according to claim 1, further comprising a filler, wherein the filler is disposed between the casing and the microphone element, the filler exposes the microphone element only on the front sound reception surface and the rear sound reception surface, and the filler isolates the front sound reception surface and the rear sound reception surface.

7. The directional microphone according to claim 1, wherein when a sound having a frequency higher than or equal to 3 kHz is received, a sensitivity difference between sounds received by the front sound reception surface and the rear sound reception surface is consistent, wherein the sensitivity difference is equal to 5 dB.

8. The directional microphone according to claim 1, wherein when a sound having a frequency higher than or equal to 5 kHz is received, a sensitivity difference between sounds received by the front sound reception surface and the rear sound reception surface is consistent, wherein the sensitivity difference is equal to 5 dB.

9. The directional microphone according to claim 1, wherein the directional microphone is a unidirectional microphone.

10. The directional microphone according to claim 1, wherein the directional microphone is a hypercardioid microphone.

11. The directional microphone according to claim 1, wherein the front sound reception hole is located on a same side as a sound source.

12. The directional microphone according to claim 1, wherein a rear side sound reception path is present between the at least one rear sound reception hole and the rear sound reception surface, a front side sound reception path is present between the front sound reception hole and the front sound reception surface, and the rear side sound reception path is longer than the front side sound reception path.

13. The directional microphone according to claim 1, wherein the casing has a pair of rear sound reception holes and a pair of rear side sound reception paths, an orientation of each of the rear sound reception holes is in line with an orientation of the rear sound reception surface, but each of the rear sound reception holes is far away from the rear sound reception surface, wherein one of the rear side sound reception paths connects one of the rear sound reception holes and the rear sound reception surface, and another of the rear side sound reception paths connects another of the rear sound reception holes and the rear sound reception surface.

* * * * *